US009932709B2

(12) United States Patent
Duggirala et al.

(10) Patent No.: US 9,932,709 B2
(45) Date of Patent: Apr. 3, 2018

(54) PROCESSES AND COMPOSITIONS FOR BRIGHTNESS IMPROVEMENT IN PAPER PRODUCTION

(71) Applicant: Ecolab USA Inc., Naperville, IL (US)

(72) Inventors: Prasad Y. Duggirala, Naperville, IL (US); Sergey M. Shevchenko, Aurora, IL (US)

(73) Assignee: ECOLAB USA INC., Naperville, IL (US)

( * ) Notice: Subject to any disclaimer, the term of this patent is extended or adjusted under 35 U.S.C. 154(b) by 120 days.

(21) Appl. No.: 13/839,091

(22) Filed: Mar. 15, 2013

(65) Prior Publication Data

US 2014/0259458 A1 Sep. 18, 2014

(51) Int. Cl.

| | |
|---|---|
| ***D21H 17/09*** | (2006.01) |
| ***D21H 17/10*** | (2006.01) |
| ***D21H 17/66*** | (2006.01) |
| ***D21H 17/15*** | (2006.01) |
| ***D21H 21/28*** | (2006.01) |
| ***D21C 9/10*** | (2006.01) |
| ***D21H 21/14*** | (2006.01) |
| ***D21H 21/30*** | (2006.01) |

(52) U.S. Cl.

CPC ..... *D21H 17/09* (2013.01); *D21C 9/1036* (2013.01); *D21C 9/1042* (2013.01); *D21C 9/1084* (2013.01); *D21H 17/10* (2013.01); *D21H 17/15* (2013.01); *D21H 17/66* (2013.01); *D21H 21/143* (2013.01); *D21H 21/28* (2013.01); *D21H 21/30* (2013.01)

(58) Field of Classification Search

CPC ..... D21C 9/10; D21C 9/1005; D21C 9/1036; D21C 9/1042; D21C 9/1084; D21C 9/1089; D21H 1/00; D21H 11/02; D21H 11/04; D21H 11/16; D21H 11/20; D21H 17/00; D21H 17/09; D21H 17/10; D21H 17/14; D21H 17/15; D21H 17/18; D21H 17/63; D21H 17/64; D21H 17/66; D21H 17/70; D21H 21/00; D21H 21/14; D21H 21/16; D21H 21/32; D21H 17/07; D21H 21/28; D21H 21/143; D21H 21/30

USPC ..... 8/119, 101, 107, 110; 162/1, 24, 70, 80, 162/82, 83, 182

See application file for complete search history.

(56) References Cited

U.S. PATENT DOCUMENTS

| | | | | |
|---|---|---|---|---|
| 2,587,064 | A * | 2/1952 | Rapson | D21C 9/144 162/87 |
| 3,013,934 | A | 12/1961 | Aitken et al. | |
| 3,017,316 | A | 1/1962 | Rapson | |
| 3,042,575 | A | 7/1962 | Hartler | |
| 3,388,037 | A | 6/1968 | Asplund et al. | |
| 3,401,076 | A | 9/1968 | Paterson et al. | |
| 3,617,431 | A | 11/1971 | Ornskoldsvik et al. | |
| 3,619,355 | A | 11/1971 | Silberman | 162/135 |
| 3,904,685 | A | 9/1975 | Shahidi et al. | 260/537 |
| 3,933,676 | A | 1/1976 | Wade | |
| 3,981,765 | A | 9/1976 | Kruger et al. | |
| 4,211,605 | A | 7/1980 | Saxton et al. | |
| 4,213,821 | A | 7/1980 | Vanderhoek et al. | |
| 4,238,282 | A | 12/1980 | Hyde | 162/76 |
| 4,324,612 | A | 4/1982 | Lindahl | |
| 4,578,148 | A | 3/1986 | Lindahl | |
| 4,767,499 | A | 8/1988 | Simonson et al. | |
| 4,826,567 | A | 5/1989 | Gratzl | |
| 5,007,985 | A | 4/1991 | Engstrand et al. | |
| 5,035,772 | A | 7/1991 | Agnemo et al. | 162/72 |
| 5,129,987 | A | 7/1992 | Joachimides et al. | |
| 5,169,555 | A * | 12/1992 | Mikulski et al. | 252/188.26 |
| 5,182,161 | A | 1/1993 | Noda et al. | |
| 5,298,118 | A | 3/1994 | Devic | |
| 5,338,402 | A | 8/1994 | Devic et al. | |
| 5,368,689 | A | 11/1994 | Agnemo | 162/135 |
| 5,534,115 | A | 7/1996 | Hoyos et al. | |
| 5,562,803 | A | 10/1996 | Wang et al. | |
| 5,656,130 | A | 8/1997 | Ali | |

(Continued)

FOREIGN PATENT DOCUMENTS

| | | | |
|---|---|---|---|
| AU | 2010202496 | A1 | 1/2012 |
| CA | 962810 | A | 2/1975 |

(Continued)

OTHER PUBLICATIONS

Kuchinskaya, O.A.; D'yachenko, Yu I.; Tumanova, T.A.; Puzyrev, S.S.; "Reducing the brightness reversion of thermo-mechanical pulp bleached with hydrogen peroxide." Journal Izvestiya Vysshikh Uchebnykh Zavedenii, Lesnoi Zhurnal 1990 No. 6 pp. 80-85; English Abstract.

Ni, Y.; Li, Z.; van Heiningen, A.R.P.; "Minimization of the brightness loss due to metal ions in process water for bleached mechanical pulps"; Pulp & Paper Canada; 98:10, 1997, pp. T396-399.

Smook, Gary A.; "Handbook for Pulp & Paper Technologists"; 1992 Angus Wilde Publications, Second Edition, pp. 38-39.

Smook, Gary A.; "Handbook for Pulp & Paper Technologists", 1992 Angus Wilde Publications, Second Edition, pp. 208 and 264.

Smook, Gary A.; "Handbook for Pulp & Paper Technologists", 1992 Angus Wilde Publications, Second Edition, pp. 207, 228 and 283.

(Continued)

*Primary Examiner* — Amina S Khan

(74) *Attorney, Agent, or Firm* — Eric D. Babych; Brinks Gilson & Lione

(57) ABSTRACT

Compositions and methods that preserve and enhance the brightness of pulp, and also improve the color of pulp or paper, when applied during different stages of a papermaking process, are disclosed. The compositions and methods maintain or enhance brightness, prevent yellowing, and enhance the performance of paper products. The compositions can include a mixture of reducing agents and can also include optical brighteners, chelants, polycarboxylates, or other additives. The mixture of reducing agents can include a borohydride, such as sodium borohydride, and any other reducing agent, such as a sulfite or bisulfite.

9 Claims, No Drawings

(56) References Cited

U.S. PATENT DOCUMENTS

| | | | | |
|---|---|---|---|---|
| H1690 | H | 11/1997 | Nye | |
| 6,241,851 | B1 | 6/2001 | Marcoccia | |
| 6,379,494 | B1 | 4/2002 | Jewell et al. | |
| 6,428,653 | B1 * | 8/2002 | Denton et al. | 162/24 |
| 6,527,914 | B1 | 3/2003 | Shevchenko et al. | 162/142 |
| 6,998,015 | B2 | 2/2006 | Hua et al. | 162/83 |
| 8,246,780 | B2 * | 8/2012 | Duggirala et al. | 162/82 |
| 2002/0059999 | A1 | 5/2002 | Hua et al. | 162/83 |
| 2002/0081428 | A1 | 6/2002 | Luo et al. | |
| 2002/0088574 | A1 | 7/2002 | Seltzer et al. | 162/72 |
| 2003/0085008 | A1 | 5/2003 | Duggirala et al. | 162/65 |
| 2003/0121625 | A1 | 7/2003 | Zhang et al. | |
| 2003/0188393 | A1 | 10/2003 | Tindal | 8/532 |
| 2004/0000012 | A1 | 1/2004 | Scarpello et al. | |
| 2004/0000380 | A1 | 1/2004 | Goda | |
| 2004/0112557 | A1 | 6/2004 | Parrish et al. | |
| 2004/0117917 | A1 | 6/2004 | Sibiet et al. | |
| 2004/0154764 | A1 | 8/2004 | Blum et al. | 162/135 |
| 2004/0173328 | A1 | 9/2004 | Hu et al. | 162/70 |
| 2004/0211533 | A1 | 10/2004 | Huang et al. | |
| 2005/0279467 | A1 | 12/2005 | Thomas et al. | |
| 2007/0062653 | A1 * | 3/2007 | Duggirala et al. | 162/9 |
| 2007/0151680 | A1 | 7/2007 | Scarpello et al. | |
| 2007/0277947 | A1 | 12/2007 | Nguyen | |
| 2008/0087390 | A1 | 4/2008 | Lee et al. | |
| 2008/0105392 | A1 | 5/2008 | Duggirala et al. | |
| 2009/0107643 | A1 | 4/2009 | Petit-Conil et al. | |
| 2010/0065233 | A1 | 3/2010 | Pipon et al. | |
| 2010/0224333 | A1 | 9/2010 | Duggirala et al. | |
| 2011/0272110 | A1 | 11/2011 | Leite | |
| 2012/0067532 | A1 * | 3/2012 | Lee | 162/5 |
| 2012/0168102 | A1 | 7/2012 | Yoon et al. | |

FOREIGN PATENT DOCUMENTS

| | | | |
|---|---|---|---|
| CA | 1251903 | A | 4/1989 |
| CA | 2157 154 | A1 | 3/1996 |
| CN | 1769584 | A | 5/2006 |
| CN | 101230552 | | 7/2008 |
| CN | 102388177 | A | 3/2012 |
| DE | 1955641 | A | 2/1971 |
| DE | 2105324 | A1 | 8/1972 |
| DE | 2826821 | | 1/1979 |
| EP | 0027369 | A1 | 4/1981 |
| EP | 0 280 332 | A1 | 8/1988 |
| EP | 0485074 | A1 | 5/1992 |
| EP | 0530881 | A1 | 3/1993 |
| EP | 0 652 321 | A1 | 5/1995 |
| EP | 0905317 | A1 | 3/1999 |
| EP | 1418269 | A1 | 5/2004 |
| EP | 2642020 | A1 | 9/2013 |
| FR | 2692917 | A1 | 12/1993 |
| JP | 48038328 | | 11/1973 |
| JP | H 0268377 | A | 3/1990 |
| JP | 09-049195 | | 2/1997 |
| SE | 738815 | | 10/1955 |
| WO | WO 88/10334 | | 12/1988 |
| WO | WO 90/11403 | | 10/1990 |
| WO | WO 92/07994 | | 5/1992 |
| WO | WO 93/16227 | | 8/1993 |
| WO | WO 95/06773 | | 3/1995 |
| WO | WO 96/20308 | | 7/1996 |
| WO | WO 97/22749 | | 6/1997 |
| WO | WO 98/31872 | | 7/1998 |
| WO | WO 01/59205 | A1 | 8/2001 |
| WO | WO 03/048450 | A1 | 6/2003 |
| WO | WO 2005/001198 | A1 | 1/2005 |
| WO | WO 2005/106110 | A1 | 11/2005 |
| WO | WO 2006/110751 | A1 | 10/2006 |
| WO | WO 2008/058003 | A2 | 5/2008 |
| WO | WO 2008/058003 | A3 | 5/2008 |
| WO | WO 2010/115090 | A1 | 10/2010 |
| WO | WO 2016/079045 | A1 | 5/2016 |

OTHER PUBLICATIONS

Ramasubramanian, M.K,; Crews, W.R.; "Shear Strength of an Adhesively Bonded Paper-Metal Interface" Journal of Pulp and Paper Science: vol. 24 No. 1 Jan. 1998, p. 31.

Bouchard, J.; Polverari, M.; Morelli, E.; Gagnon, P.; Picotte, R.; "Brightness reversion and brightness loss in fully-bleached kraft pulp: a case study"; Pulp & Paper Canada; 101:8, 2000, pp. T232-236.

Roick, Dr. Thomas; "Optical Brighteners in Fine Papers"; 1999 TAPPI Press , pp. 821-828.

Ni, Y.; Ghosh, Z.; Li, C.; Heitner, C.; McGarry, P.; "Photostabilization of Bleached Mechanical Pulps with DTPA Treatment"; Journal of Pulp and Paper Science: vol. 24 No. 8, Aug. 1998, pp. 259-262.

Tran, A.V.; "Thermal Yellowing of Hardwood Kraft Pulp Beached with a Chlorine Dioxide Based Sequence"; Journal of Pulp and Paper Science: vol. 28 No. 4, Apr. 2002, pp. 115-121.

Ghosh, A., Ni, Y.; "Metal Ion Complexes and Their Relationship to Pulp Brightness"; Journal of Pulp and Paper Science: vol. 24 No. 1, Jan. 1998, pp. 26-31.

Davidson, R.S.; Dunn, L.A.; Castellan, A.; Colombo, N.; Nourmamode, A.; Zhu, J.H.; "A Study of the Photoyellowing of Paper Made from Bleached CTMP"; Journal of Wood Chemistry and Technology, 11(4), 1991, pp. 419-437.

International Search Report and The Written Opinion from corresponding PCT Appln. No. PCT/US2014/016901 dated Jul. 22, 2014 (13 pgs).

International Search Report and Written opinion for International Application No. PCT/US2017/043099, dated Oct. 4, 2017, 12 pages.

Akgül, Mehmet and S. Temiz. "Determination of Kraft-$NaBH_4$ Pulping Condition of Uludag Fir." Pakistan Journal of Biological Sciences (2006), vol. 9, No. 13, pp. 2493-2497.

Aurell, Ronnie and N Hartler. "Sulfate Cooking with the Addition of Reducing Agents, Part III: The Effect of Added Sodium Borohydride." Tappi Journal (Apr. 1963), vol. 46, pp. 209-215.

Betz, R. G. and G. E. Styan, "Brightening of Douglas Fir Groundwood." Pulp & Paper Magazine of Canada (1974), vol. 75, pp. 111-114.

Dence, Carlton W. and D. W. Reeve, Editors. "Pulp Bleaching—Principles and Practice." TAPPI Press (1996), pp. 468-471.

Diaconescu V. and S Petrovan. "Studies on the Kinetics of Sulfate Pulping with the Addition of Sodium Borohydride." Cellulose Chemistry and Technology (1976), vol. 10, No. 3, pp. 357-378.

Diaconescu, V. and S. Petrovan. "Spruce Sulfate Cooking with Sodium Borohydride Makeup, Part II: Influence of Cooking Parameters on Pulp Lignin Content." Romanian Celuloza si Hirtie (1956-1974) (1971), vol. 20, No. 12, pp. 546-551, with English Abstract.

Digital Analysis Corporation, "Magnesium Hydroxide," Downloaded online from www.phadjustment.com . Downloaded on Mar. 21, 2016, two pages.

Dou, Zheng-yuan, "$NaBH_4$ Pretreatment Assisted $H_2O_2$ Bleaching Process for Mechanical Pulp." Paper and Paper Making (Sep. 2005), No. 5, pp. 24-25. English Abstract on second page of document.

Fleming, B.I. And H.I. Bolker. "Reducing agents as additives for soda pulping." Svensk Papperstidning (1978), vol. 81, No. 1, pp. 13-18.

Gugnin, Y.A., "Kraft Pulping with Addition of Sodium Borohydride," Izvestiya Vysshikh Uchebnykh Zavedenii, Lesnoi Zhurnal (1964), vol. 7, No. 5, pp. 160-166, with English Abstract.

Foelkel, Celso E.B and A. Fernandes. "Use of Sodium Tetrahydroborate as an Additive in Kraft Process." Papel (1980), vol. 41 (Aug.), pp. 69-72, with English Abstract.

Gellerstedt, Göran. "Chapter 25: Pulping Chemistry," Wood and Cellulosic Chemistry, First Edition, Eds. Hon, D. N.-S. and N. Shiraishi. New York: Marcel Dekker, (2001), pp. 859-905.

Gierer, Josef and I. Noren. "Contribution to the Chemistry of Alkaline Wood Cooking." Papier (1981), vol. 35, No. 10A, pp. 18-24, with English Abstract.

Gulsoy, Sezgin Koray and H. Eroglu. "Influence of Sodium Borohydride on Kraft Pulping of European Black Pine as a Digester Additive." Industrial & Engineering Chemistry Research (2011), vol. 50, pp. 2441-2444.

(56) References Cited

OTHER PUBLICATIONS

Hartler, N. "Additives as Cooking Aids." EUCEPA Symposium, (1980), pp. 1-29.
He, Zhibin, Y. Ni, and E. Zhang. "Further Understanding of Sodium Borohydride Assisted Peroxide Bleaching of Mechanical Pulps (the $P_R$ Process)." Appita Journal (2005), vol. 58, No. 1, pp. 72-76.
Istek, Abdullah and E. Gonteki. "Utilization of Sodium Borohydride ($NaBH_4$) in Kraft Pulping Process." Journal of Environmental Biology (Nov. 2009), vol. 30, No. 6, pp. 951-953.
Leary, Gordon, D. Wong, and D. Giampaolo. "The Bleaching of Mechanical Pulps with Oxygen and Borohydride." Holzforschung (1997), vol. 51, No. 5, pp. 445-451.
Meller, Alexander and E. L. Ritman. "Retention of Polysaccharides in Kraft Pulping, Part III: Sheet and Fiber Strength Properties and Water Retention Capacity of Kraft and Borohydride Kraft Pulps." Tappi Journal (Oct. 1964), vol. 47, No. 10, pp. 634-639.
Meizer, J. And W. Auhorn, "Treatment of Wood Pulp with Reductive Bleaching Chemicals in Refiners." Wochenblatt fur Papierfabrikation (1986), vol. 114, No. 8, pp. 257-260.
Rangamanner, Goda, J. Bettano, and R Hebert. "'DBI' Bleaching of Recycled Fibers for the Production of Towel and Napkin Grades." TAPPI Engineering, Pulping and Environmental Conference, Philadelphia, PA, US, Aug. 28-31, 2005.
Sellers, F.G., "New Hydrosulfite Route Reduces Groundwood Bleach Costs." Pulp & Paper (1973), vol. 47, Issue 12 pp. 80-82.
Smook, Gary A. "Handbook for Pulp & Paper Technologists." Vancouver, BC, CA: Augus Wilde Publications Inc., (1992), Second Edition, Chapter 11, pp. 163-185.
Sundholm, Jan, Editor. "Mechanical Pulping." Helsinki, FI: Rapet Oy, (1999), pp. 331-334.
Takahashi, Shonosuke, T. Shiraishi, and Y. Fukuda. "Hardwood Dissolving Sulfate Pulp, Part III 3: Factors on Removing Pentosans." Nippon Nogei Kagaku Kaishi (1960), vol. 34, pp. 857-863, with English Abstract.
Treimanis, A. and V. S. Gromov. "Aspects of the Alkaline Cooking of Birch Wood in the Presence of Sodium Borohydride." Latvijas PSR Zinatnu Akademijas Vestis (1970), vol. 2, No. 271, pp. 48-51, with English Abstract.
Wasshausen, J., G. Rangamannar, R. Amyotte, and B.Cordy. "'Premix': A Novel Process for Improved Bleaching of Mechanical Pulps Using a Mixture of Reductive Agents." Pulp & Paper Canada (2006), vol. 107, No. 3, pp. 44-47.
Yoon, Sung-Hoon, H. Cullinan, and G. A. Krishnagopalan. "Polysulfide-Borohydride Modification of Southern Pine Alkaline Pulping Integrated with Hydrothermal Pre-extraction of Hemicelluloses." Tappi Journal (Jul. 2011), vol. 10, No. 7, pp. 9-16.

* cited by examiner

PROCESSES AND COMPOSITIONS FOR BRIGHTNESS IMPROVEMENT IN PAPER PRODUCTION

CROSS-REFERENCE TO RELATED APPLICATIONS

Not Applicable

FEDERALLY SPONSORED RESEARCH OR DEVELOPMENT

Not Applicable

THE NAMES OF THE PARTIES TO A JOINT RESEARCH AGREEMENT

Not Applicable

REFERENCE TO A SEQUENCE LISTING, A TABLE, OR A COMPUTER PROGRAM LISTING COMPACT DISC APPENDIX

Not Applicable

BACKGROUND OF THE INVENTION

1. Field of the Invention

This disclosure relates to compositions and processes for improving brightness and optical properties, preventing loss of brightness, and enhancing resistance to thermal yellowing in pulp and paper manufacture. More particularly, this disclosure relates to compositions comprising borohydrides, which either alone, or in the presence of optical brightening agents, effectively enhance the brightness and optical properties of a paper product as well as increase its thermal stability.

2. Description of the Related Art

Pulps produced by either mechanical or chemical pulping methods possess a color that can range from dark brown to cream, depending on the wood type and defibering process used. The pulp is bleached to produce white paper products for a multiplicity of applications.

Bleaching is the removal or alteration of those light-absorbing substances found in unbleached pulp. In the bleaching of mechanical pulp, the object is to decolorize the pulp without solubilizing the lignin. Either reducing (e.g. sodium hydrosulfite) or oxidizing (e.g., hydrogen peroxide) bleaching agents are usually used. The bleaching is often a multistage process. The bleaching of chemical pulps is an extension of the delignification that started in the digestion stage. The bleaching is often a multistage process, which stages may include chlorine dioxide bleaching, oxygen-alkaline delignification, and peroxide bleaching.

Discoloration mostly ascribed to thermal aging, results in yellowing and brightness loss in various stages of papermaking processes employing bleached pulp, as well as in the resultant paper products. The industry significantly invests in chemicals, such as bleaching agents and optical brighteners, which improve optical properties of the finished paper or paper products. To date, however, the results have been less than satisfactory and the economic losses resulting from discoloration and yellowing present significant ongoing challenges to the industry. Accordingly, there remains a need for a successful and practical solution to prevent the loss of brightness and undesirable yellowing of pulp and paper.

Previous technology has been developed to improve and stabilize brightness, and enhance resistance to yellowing in the papermaking process (see U.S. Pat. No. 8,246,780, the contents of which are expressly incorporated into the present application by reference). In further development, the present inventors have discovered a way to significantly improve this technology based on unexpected synergism between a composition described in U.S. Pat. No. 8,246,780, and another reductive chemical, which is not taught or suggested in this reference.

BRIEF SUMMARY OF THE INVENTION

In an aspect, the present disclosure provides a method for preparing a bleached pulp material having enhanced brightness and enhanced resistance to thermal yellowing. The method comprises the steps of i) providing bleached pulp material; and ii) contacting the bleached pulp material with an effective amount of a mixture of reducing agents comprising a borohydride.

In another aspect, the present disclosure provides a method of preventing brightness loss and yellowing of a bleached pulp material during storage. The method comprises adding an effective amount of a mixture of reducing agents comprising a borohydride to the bleached pulp material. Optionally, the method further comprising the step of adding one or more chelants, one or more polycarboxylates, or a combination thereof, to the bleached pulp material. Optionally, the mixture of reducing agents and optional one or more chelants, and optional one or more polycarboxylates can be added to the bleached pulp after a bleaching stage in a storage, blending, or transfer chest.

In a further aspect, the present disclosure provides a composition comprising a mixture of reducing agents comprising a borohydride and one or more optical brightening agents. Optionally, the composition can also comprise one or more chelants, one or more polycarboxylates, or any combination of one or more chelants and one or more polycarboxylates.

The foregoing has outlined rather broadly the features and technical advantages of the present disclosure in order that the detailed description that follows may be better understood. Additional features and advantages of the disclosure will be described hereinafter that form the subject of the claims of this application. It should be appreciated by those skilled in the art that the conception and the specific embodiments disclosed may be readily utilized as a basis for modifying or designing other embodiments for carrying out the same purposes of the present disclosure. It should also be realized by those skilled in the art that such equivalent embodiments do not depart from the spirit and scope of the disclosure as set forth in the appended claims.

BRIEF DESCRIPTION OF THE SEVERAL VIEWS OF THE DRAWINGS

Not Applicable

DETAILED DESCRIPTION OF THE INVENTION

This disclosure provides an improved process for making paper and paper products exhibiting high optical brightness. Brightness stabilization against thermal yellowing, color improvements, and brightness enhancements of bleached pulp, and paper products prepared from the bleached pulp, can be achieved by adding a mixture of reducing agents comprising a borohydride as defined herein to pulp, paper, paperboard, and/or tissue, at any stage in the papermaking process.

Brightness is a term used to describe the whiteness of pulp or paper, on a scale from 0% (absolute black) to 100% (relative to a MgO standard, which has an absolute brightness of about 96%) by the reflectance of blue light (457 nm) from the paper. "Thermal brightness loss" is a brightness loss in paper and pulp under the influence of time, temperature and moisture (non-photochemical brightness loss). "Brightness loss during storage" is thermal brightness loss over time under storage conditions.

Yellowing of a bleached pulp material (brightness reversion) is the loss of brightness of bleached pulp, paper, paperboard, paper tissue, and related materials, prepared from the bleached pulp over a period of time.

The reducing agents described herein are suitable for use on any bleached pulp material used in papermaking processes and any paper product prepared from the bleached pulp. As used herein, "bleached pulp material" means bleached pulp and paper products prepared from the bleached pulp including paper, paperboard, tissue, and the like.

Reducing agents according to this disclosure include chemical substances capable of transforming functional groups in the bleached pulp from a higher oxidation category to a lower oxidation category. The benefits of this transformation include increased brightness stability in the paper machine and enhanced performance of optical brighteners.

In an aspect, the reducing agent comprises a mixture of reducing agents comprising a borohydride and one or more reducing agents selected from the group consisting of sulfites, bisulfites, metabisulfites (pyrosulfites), sulfoxylates, thiosulfates, dithionites (hydrosulfites), polythionates, and formamidinesulfinic acid and/or salts thereof. The mixture of reducing agents can comprise a borohydride and any combination of the foregoing additional reducing agents. For example, the mixture of reducing agents can comprise a borohydride, a sulfite, a bisulfite, and a metabisulfite.

As used herein, "sulfites" means dibasic metal salts of sulfurous acid, $H_2SO_3$, including dibasic alkali and alkaline earth metal salts, such as sodium sulfite ($Na_2SO_3$), calcium sulfite ($CaSO_3$), and the like.

"Bisulfites" means monobasic metal salts of sulfurous acid, including alkali and alkaline earth metal monobasic salts, such as sodium bisulfite ($NaHSO_3$), magnesium bisulfite ($Mg(HSO_3)_2$), and the like.

"Sulfoxylates" means salts of sulfoxylic acid, $H_2SO_2$, including zinc sulfoxylate ($ZnSO_2$), and the like.

"Metabisulfites (Pyrosulfites)" means salts of pyrosulfurous acid, $H_2S_2O_5$, including sodium metabisulfite ($Na_2S_2O_5$), and the like.

"Thiosulfates" means salts of thiosulfurous acid, $H_2S_2O_3$, including potassium thiosulfate ($Na_2S_2O_3$), and the like.

"Polythionates" means salts of polythionic acid, $H_2S_nO_6$ (n=2-6), including sodium trithionate ($Na_2S_3O_6$), salts of dithionic acid, $H_2S_2O_6$, such as sodium dithionate $Na_2S_2O_6$, and the like.

"Dithionites (hydrosulfites)" means salts of dithionous (hydrosulfurous, hyposulfurous) acid, $H_2S_2O_4$, including sodium dithionite (hydrosulfite) ($Na_2S_2O_4$), magnesium dithionite ($MgS_2O_4$), and the like.

"Formamidinesulfinic acid (FAS)" means a compound of formula $H_2NC(=NH)SO_2H$ and its salts and derivatives including the sodium salt $H_2NC(=NH)SO_2Na$.

"Borohydrides" means compounds of a formula M(+n)($BH_4$)n where M is a metal cation. Complex borohydrides that contain more than one type of metal are also included. The borohydrides can be water-soluble under the conditions where they do not decompose upon contact with water.

"Salt" means the metal, ammonium, substituted ammonium, or phosphonium salt of an inorganic or organic anionic counterion. Representative metals include sodium, lithium, potassium, calcium, magnesium, and the like. Representative anionic counterions include sulfite, bisulfite, sulfoxylate, metabisulfite, thiosulfate, polythionate, hydrosulfite, formamidinesulfinate, and the like.

In an aspect, components of the mixture of reducing agents are selected from two groups. From group 1, the mixture of reducing agents can include one or more than one compound selected from sulfites, bisulfites, metabisulfites (pyrosulfites), sulfoxylates, thiosulfates, dithionites (hydrosulfites), polythionates, and formamidinesulfinic acid and salts and derivatives thereof. From group 2, the mixture of reducing agents can include one or more borohydrides. In an aspect, the one or more borohydrides comprises an alkaline solution of sodium borohydride, $NaBH_4$, which contains approximately 12% $NaBH_4$ and approximately 39% NaOH, although in some embodiments, the $NaBH_4$ can range from about 5% to about 25% and the NaOH can range from about 25% to about 50%.

In an aspect, the mixture of reducing agents comprises sodium bisulfite and sodium borohydride. In another aspect, the mixture of reducing agents comprises sodium bisulfite and an alkaline solution of sodium borohydride, $NaBH_4$, which contains approximately 12% $NaBH_4$ and approximately 39% NaOH, although in some embodiments, the $NaBH_4$ can range from about 5% to about 25% and the NaOH can range from about 25% to about 50%.

The processes of the present disclosure can be practiced on conventional papermaking equipment. Although papermaking equipment varies in operation and mechanical design, the processes by which paper is made on different equipment contain common stages. Papermaking typically includes a pulping stage, bleaching stage, stock preparation stage, a wet end stage, and a dry end stage.

In the pulping stage, individual cellulose fibers are liberated from a source of cellulose either by mechanical action, chemical action, or both. Representative sources of cellulose include, but are not limited to, wood and similar "woody" plants, soy, rice, cotton, straw, flax, abaca, hemp, bagasse, lignin-containing plants, and the like, as well as original and recycled paper, paper tissue, and paperboard. Such pulps include, but are not limited to, groundwood (GWD), bleached groundwood, thermomechanical pulps (TMP), bleached thermomechanical pulps, chemi-thermomechanical pulps (CTMP), bleached chemi-thermomechanical pulps, deinked pulps, kraft pulps, bleached kraft pulps, sulfite pulps, and bleached sulfite pulps. Recycled pulps may or may not be bleached in the recycling stage, but they are presumed to be originally bleached. Any of the pulps described above which have not previously been subjected to bleaching may be bleached as described herein to provide a bleached pulp material.

In an aspect of this disclosure, the bleached pulp material is selected from the group consisting of virgin pulp, recycled pulp, kraft, sulfite pulp, mechanical pulp, any combination of such pulps, recycled paper, paper tissue, and any paper made from such listed pulps or combinations thereof.

An advantage of this disclosure is that it allows for substituting lower-priced mechanical pulp for higher priced kraft pulp in printing grade kraft-mechanical paper. Use of the chemistry and methods described herein increases the brightness and stability toward yellowing, therefore permitting the use of higher amounts of mechanical pulp, with corresponding reduction in cost, without loss of quality in the resulting paper product.

In the papermaking process, pulp is suspended in water in the stock preparation stage. Additives, such as brightening agents, dyes, pigments, fillers, antimicrobial agents, defoamers, pH control agents, and drainage aids may also be added to the stock at this stage. As the term is used in this disclosure, "stock preparation" includes such operations as dilution, screening, and cleaning of the stock suspension that may occur prior to forming of the web.

The wet end stage of the papermaking process comprises depositing the stock suspension or pulp slurry on a wire or felt of the papermaking machine to form a continuous web of fibers, draining of the web, and consolidation of the web ("pressing") to form a sheet. Any papermaking machine known in the art is suitable for use with the processes of the present disclosure. Such machines may include cylinder machines, fourdrinier machines, twin wire forming machines, tissue machines, and the like, and modifications thereof.

In the dry end stage of the papermaking process, the web is dried and may be subjected to additional processing, such as size pressing, calendering, spray coating with surface modifiers, printing, cutting, corrugating, and the like. In addition to a size press and calender waterbox, the dried paper can be coated by spray coating using a sprayboom.

In accordance with this disclosure, the inventors have discovered that certain reducing agents, such as borohydrides, in combination with other reducing agents, such as sodium bisulfite, and/or chelants, as described below, unexpectedly and effectively enhanced the brightness of a paper product via increased thermal stability of the pulp, and reduction of chromophoric structures in the pulp.

In an aspect of the present disclosure, one or more chelants are added to the bleached pulp or paper product in combination with the mixture of reducing agents. Suitable chelants according to this disclosure include compounds that are capable of chelating transitional metals that form colored products with pulp constituents and catalyze color-forming reactions in the bleached pulp or paper products.

In an aspect, the chelant is a compound selected from the group consisting of organic phosphonate, phosphate, carboxylic acids, dithiocarbamates, salts of any of the previous members, and any combination thereof.

"Organic phosphonates" means organic derivatives of phosphonic acid, $HP(O)(OH)_2$, containing a single C—P bond, such as HEDP ($CH_3C(OH)(P(O)(OH)_2)$, 1-hydroxy-1,3-propanediylbis-phosphonic acid ($(HO)_2P(O)CH(OH)CH_2CH_2P(O)(OH)_2)$); preferably containing a single C—N bond adjacent (vicinal) to the C—P bond, such as DTMPA ($(HO)_2P(O)CH_2N[CH_2CH_2N(CH_2P(O)(OH)_2)_2]_2$), AMP ($N(CH_2P(O)(OH)_2)_3$), PAPEMP ($(HO)_2P(O)CH_2)_2NCH(CH_3)CH_2(OCH_2CH(CH_3))_2N(CH_2)_6N(CH_2P(O)(OH)_2)_2$), HMDTMP ($(HO)_2P(O)CH_2)_2N(CH_2)_6N(CH_2P(O)(OH)_2)_2$), HEBMP ($N(CH_2P(O)(OH)_2)_2CH_2CH_2OH$), and the like.

"Organic phosphates" means organic derivatives of phosphorous acid, $P(O)(OH)_3$, containing a single C—P bond, including triethanolamine tri(phosphate ester) ($N(CH_2CH_2OP(O)(OH)_2)_3$), and the like.

"Carboxylic acids" means organic compounds containing one or more carboxylic group(s), —C(O)OH, preferably aminocarboxylic acids containing a single C—N bond adjacent (vicinal) to the $C—CO_2H$ bond, such as EDTA ($(HO_2CCH_2)_2NCH_2CH_2N(CH_2CO_2H)_2$), DTPA ($(HO_2CCH_2)_2NCH_2CH_2N(CH_2CO_2H)CH_2CH_2N(CH_2CO_2H)_2$), and the like, and alkaline and alkaline earth metal salts thereof.

"Dithiocarbamates" include monomeric dithiocarbamates, polymeric dithiocarbamates, polydiallylamine dithiocarbamates, 2,4,6-trimercapto-1,3,5-triazine, disodium ethylenebisdithiocarbamate, disodium dimethyldithiocarbamate, and the like.

In an aspect, the chelant is a phosphonate.

In a particular aspect, the phosphonate is diethylenetriamine-pentamethylene phosphonic acid (DTMPA) and/or salts thereof.

In another aspect, the chelant is a carboxylic acid.

In a particular aspect, the carboxylic acid is one of, or a combination of, diethylenetriaminepentaacetic acid (DTPA) and salts thereof, and ethylenediaminetetraacetic acid (EDTA) and salts thereof.

The inventors have also discovered that when the mixture of reducing agents comprises a very minimal amount of one or more borohydrides, such as about 1% to about 10% of the mixture of reducing agents being one or more borohydrides, in combination with one or more optical brightening agents ("OBAs"), the minimal amount of borohydride significantly and unexpectedly enhances the effect of the OBAs and thus, synergism has been found between components of the mixture of reducing agents and the OBAs. The mixture of reducing agents, when comprising only a minimal amount of one or more borohydrides, also improves the color scheme. This permits reduction of the amount of OBAs and brighteners, such as blue dyes, necessary to achieve comparable brightness and color. Replacing some of the OBAs and dyes with the presently disclosed mixture of reducing agents comprising only a minimal amount of one or more borohydrides allows pulp and paper manufacturers to reduce production costs and reduce the overall amount of OBAs and dyes present, while maintaining an acceptable level of brightness in the paper product and achieving the target color. In some aspects, it may be possible to eliminate dyes entirely and maintain color.

The foregoing paragraph is equally applicable to the effect that the minimal amount of the one or more borohydrides has on the other components (other reducing agents) of the mixture of reducing agents. For example, the inventors have discovered that when the mixture of reducing agents comprises a minimal amount of one or more borohydrides, such as about 1% to about 10% of the mixture of reducing agents being one or more borohydrides, the minimal amount of the one or more borohydrides significantly and unexpectedly enhances the effect of the other reducing agents in the mixture of reducing agents. The mixture of reducing agents, when comprising only a minimal amount of one or more borohydrides in addition to other reducing agents, improves the color scheme. This permits reduction of the amount of reducing agents other than the one or more borohydrides in the mixture of reducing agents necessary to achieve comparable brightness and color. Lowering the amount of reducing agents in the mixture of reducing agents while adding only a minimal amount of one or more borohydrides to the mixture of reducing agents allows pulp and paper manufacturers to reduce production costs while maintaining an acceptable level of brightness, or even improving the level of brightness, in the paper product and achieving the target color.

Accordingly, in another embodiment, one or more OBAs are added to the bleached pulp or paper product in addition to the mixture of reducing agents and optionally, one or more chelants are also added.

"Optical brighteners" are fluorescent dyes or pigments that absorb ultraviolet radiation and reemit it at a higher frequency in the visible spectrum (blue), thereby providing a white, bright appearance to the paper sheet when added to the stock furnish. Representative optical brighteners include, but are not limited to, azoles, biphenyls, coumarins, furans, ionic brighteners including anionic, cationic, and anionic (neutral) compounds, and any combinations of the foregoing.

The dosage of reducing agents, chelants, and/or optical brighteners is the amount necessary to achieve the desired brightness and resistance to yellowing of the bleached pulp or paper product prepared from the bleached pulp, and can be readily determined by one of ordinary skill in the art, based on the characteristics of the chelant or optical brightener, the pulp or paper being treated, and the method of application.

The effective amount of the mixture of reducing agents added to the bleached pulp or paper product is the amount of the mixture that enhances the brightness and resistance to thermal yellowing of the pulp or paper, compared to pulp or paper that is not treated with the presently disclosed reducing agents. Methods for determining brightness and resistance to thermal yellowing are described herein.

In an aspect, from about 0.005 to about 2 weight percent, based on oven-dried pulp, of the mixture of reducing agents is added to the bleached pulp or paper product. In other aspects, from about 0.05 to about 0.25 weight percent, based on oven-dried pulp, of the mixture of reducing agents is added to the bleached pulp or paper product. In any of these aspects, the mixture of reducing agents can comprise from about 1% to about 25% of one or more borohydrides. For example, the mixture of reducing agents can comprise from about 99% to about 90% of one or more reducing agents selected from the group consisting of sulfites, bisulfites, metabisulfites (pyrosulfites), sulfoxylates, thiosulfates, dithionites (hydrosulfites), polythionates, and formamidinesulfinic acid and salts and derivatives thereof, and from about 1% to about 10% of one or more borohydrides. As an additional example, the mixture of reducing agents can comprise from about 99% to about 90% of sodium bisulfite and from about 1% to about 10% of sodium borohydride.

In an aspect, about 0.001 to about 1 weight percent of phosphonate, phosphate or carboxylic acid chelant, and/or about 0.002 to about 0.02 weight percent of dithiocarbamates chelant, based on oven-dried pulp, is added to the bleached pulp or paper product, in addition to the mixture of reducing agents. In another aspect, about 0.01 to about 0.1 weight percent of phosphonate, phosphate or carboxylic acid chelant, and/or about 0.002 to about 0.02 weight percent of dithiocarbamates chelant, based on oven-dried pulp, is added to the bleached pulp or paper product, in addition to the mixture of reducing agents.

In certain aspects, optical brighteners are added in amounts of about 0.005 to about 2 weight percent of optical brightener, based on oven-dried pulp, in addition to the mixture of reducing agents. In other aspects, optical brighteners are added in amounts of about 0.05 to about 1 weight percent of optical brightener, based on oven-dried pulp, in addition to the mixture of reducing agents.

The mixture of reducing agents, chelants, and/or optical brighteners can be added to bleached pulp or paper at any point in the papermaking or tissue making process. Representative addition points include, but are not limited to, (a) the pulp slurry in the latency chest; (b) to the pulp after the bleaching stage in a storage, blending or transfer chest; (c) to pulp after bleaching, washing and dewatering followed by cylinder or flash drying; (d) before or after the cleaners; (e) before or after the fan pump to the paper machine headbox; (f) to the paper machine white water; (g) to the silo or save all; (h) in the press section using, for example, a size press, coater or spray bar; (i) in the drying section using, for example, a size press, coater or spray bar; (j) on the calender using a wafer box; (k) on paper in an off-machine coater or size press; and/or (l) in the curl control unit.

The precise location where the mixture of reducing agents, chelants, and/or optical brighteners should be added will depend on the specific equipment involved, the exact process conditions being used, and the like. In some cases, the mixture of reducing agents, chelants, and/or optical brighteners may be added at one or more locations for optimal effectiveness.

Application can be by any means conventionally used in papermaking processes, including by "split-feeding," whereby a portion of the mixture of reducing agents, chelant, and/or optical brightener is applied at one point in the papermaking process, for example, on pulp or a wet sheet (before the dryers), and the remaining portion is added at a subsequent point, for example, in the size press.

The chelant(s) and/or optical brightener(s) can be added to the bleached pulp or paper product before, after, or simultaneously with the mixture of reducing agents. The optical brightener(s) and/or chelant(s) may also be formulated with the mixture of reducing agents.

In an aspect, the mixture of reducing agents and one or more optical brighteners are mixed with the surface sizing solution and applied in the size press.

In another aspect, the mixture of reducing agents is added to bleached pulp after the bleaching stage in the storage, blending or transfer chest.

At these various locations, the mixture of reducing agents, chelants, and/or optical brighteners can also be added with a carrier or additive typically used in paper making, such as retention aids, sizing aids and solutions, starches, precipitated calcium carbonate, ground calcium carbonate, or other clays or fillers, and brightening additives.

In an aspect, the mixture of reducing agents, chelants, and/or optical brighteners are used in combination with one or more partially neutralized polycarboxylic acids, such as polyacrylic acid $(CH_3CH(CO_2H)[CH_2CH(CO_2H)]_n CH_2CH_2CO_2H$, where n is about 10 to about 50,000. The polycarboxylic acid may be neutralized to the target pH, (typically 5-6 as discussed below) with alkali, such as sodium hydroxide.

In accordance with the present disclosure, a formulation is provided comprising one or more chelants, the mixture of reducing agents, and one or more polycarboxylic acids. The formulation preferably has a pH of about 4-7. In certain aspects, the formulation has a pH of between about 5 and about 6.

In an aspect, a formulation is provided comprising the mixture of reducing agents, one or more optical brighteners, optionally one or more chelants, and optionally one or more polycarboxylates. Formulations according to this aspect have a pH of about 7-11, and in certain aspects, the pH is between about 9 and about 10.

The mixture of reducing agents, chelants, optical brighteners, and/or polycarboxylates may be used in addition to other additives conventionally used in papermaking to improve one or more properties of the finished paper product, assist in the process of manufacturing the paper itself, or both. These additives are generally characterized as either functional additives or control additives.

Functional additives are typically those additives that are used to improve or impart certain specifically desired properties to the final paper product, and include, but are not limited to, brightening agents, dyes, fillers, sizing agents, starches, and adhesives.

Control additives, on the other hand, are additives incorporated during the process of manufacturing the paper so as to improve the overall process without significantly affecting the physical properties of the paper. Control additives include biocides, retention aids, defoamers, pH control agents, pitch control agents, and drainage aids. Paper and paper products made using the processes of the present disclosure may contain one or more functional additives and/or one or more control additives.

Pigments and dyes can also be added, and they impart color to paper. Dyes include organic compounds having conjugated double bond systems, azo compounds, metallic azo compounds, anthraquinones, triaryl compounds such as triarylmethane, quinoline and related compounds, acidic dyes (anionic organic dyes containing sulfonate groups, used with organic rations such as alum), basic dyes (cationic organic dyes containing amine functional groups), direct dyes (acid-type dyes having high molecular weights and a specific, direct affinity for cellulose), as well as combinations of the above-listed suitable dye compounds. Pigments are finely divided minerals that can be either white or colored. The pigments that are most commonly used in the papermaking industry are clay, calcium carbonate, and titanium dioxide.

Fillers are added to paper to increase opacity and brightness. Fillers include, but are not limited to, calcium carbonate (calcite), precipitated calcium carbonate (PCC), calcium sulfate (including the various hydrated forms), calcium aluminate, zinc oxides, magnesium silicates such as talc, titanium dioxide ($TiO_2$) such as anatase or rutile, clay or kaolin consisting of hydrated $SiO_2$ and $Al_2O_3$, synthetic clay, mica, vermiculite, inorganic aggregates, perlite, sand, gravel, sandstone, glass beads, aerogels, xerogels, seagel, fly ash, alumina, microspheres, hollow glass spheres, porous ceramic spheres, cork, seeds, lightweight polymers, xonotlite (a crystalline calcium silicate gel), pumice, exfoliated rock, waste concrete products, partially hydrated or unhydrated hydraulic cement particles, diatomaceous earth, as well as combinations of such compounds.

Sizing agents are added to the paper during the manufacturing process to aid in the development of a resistance to penetration of liquids through the paper. Sizing agents can be internal sizing agents or external (surface) sizing agents, and can be used for hard-sizing, slack-sizing, or both methods of sizing. More specifically, sizing agents include rosin, rosin precipitated with alum ($Al_2(SO_4)_3$), abietic acid and abietic acid homologues such as neoabietic acid and levopimaric acid, stearic acid and stearic acid derivatives, ammonium zirconium carbonate, silicone and silicone-containing compounds, fluorochemicals, alkyl succinic anhydride (ASA), emulsions of ASA or AKD with cationic starch, ASA incorporating alum, starch, hydroxymethyl starch, carboxymethylcellulose (CMC), polyvinyl alcohol, methyl cellulose, alginates, waxes, wax emulsions, and combinations of such sizing agents.

Starch has many uses in papermaking. For example, it functions as a retention agent, dry-strength agent, and surface sizing agent. Starches include, but are not limited to, amylose, amylopectin, starches containing various amounts of amylose and amylopectin such as 25% amylose and 75% amylopectin (corn starch) and 20% amylose and 80% amylopectin (potato starch), enzymatically treated starches, hydrolyzed starches, heated starches which are also known in the art as "pasted starches," cationic starches such as those resulting from the reaction of a starch with a tertiary amine to form a quaternary ammonium salt, anionic starches, ampholytic starches (containing both cationic and anionic functionalities), cellulose and cellulose derived compounds, and combinations of these compounds.

Methods and compositions of this disclosure yield paper products with a bright surface. Moreover, the compositions of this disclosure further protect paper from long-term discoloration during regular use.

In an aspect, the present disclosure provides a method of making a paper product having enhanced brightness and resistance to thermal yellowing. The method comprises i) providing bleached pulp; ii) forming an aqueous stock suspension comprising the bleached pulp; iii) draining the stock suspension to form a sheet; and iv) drying the sheet, wherein an effective amount of a mixture of reducing agents is added to the bleached pulp, the stock suspension, or on to the sheet. The method can also comprise the steps of adding one or more chelants, one or more optical brightening agents, and/or one or more polycarboxylates, or any combination thereof, to the bleached pulp, the stock suspension, or on to the sheet. Paper products prepared according to this method are also intended to be covered by the present disclosure.

In another aspect, a method for preparing a bleached pulp material having enhanced brightness and enhanced resistance to thermal yellowing is disclosed. The method comprises i) providing bleached pulp material; and ii) contacting the bleached pulp material with an effective amount of a mixture of reducing agents comprising a borohydride. Paper products prepared according to this method are also intended to be covered by the present disclosure.

In a further aspect, a method of preventing brightness loss and yellowing of a bleached pulp material during storage is provided. The method comprises the steps of adding an effective amount of a mixture of reducing agents comprising a borohydride to the bleached pulp material. The method optionally includes the step of adding one or more chelants to the bleached pulp material. The method also optionally includes the step of adding one or more polycarboxylates to the bleached pulp material. According to this method, the mixture of reducing agents and optional one or more chelants, and optional one or more polycarboxylates, can be added to the bleached pulp after a bleaching stage in a storage, blending, or transfer chest. Paper products prepared according to this method are also intended to be covered by the present disclosure.

The present inventors have discovered an unexpected, dramatic enhancing effect between certain components of the mixture of reducing agents, such as the effect that the one or more borohydrides has on the other reducing agents, such as the sulfites or bisulfites. While not wishing to be bound by any theory, it could be said that the borohydride component prevents the unproductive consumption of the other reducing agents in the mixture of reducing agents, such as sulfites and bisulfites, by preventing their reaction with non-target components. It may also be said that the one or more borohydrides act as activators that activate other reducing chemicals in the mixture of reducing agents, such as sulfites and bisulfites, to achieve an enhanced effect. These effects can be seen in the following examples. Thus, each component of the mixture of reducing agents is not simply performing the same function it had been known to perform. The borohydride component of the mixture of reducing agents has an enhancing effect on, for example, the other components of the mixture of reducing agents. Thus, the effect of the present treatment comprising one or more borohydrides in the mixture of reducing agents, and any of the additives disclosed herein, such as OBAs, is unexpectedly stronger than previous disclosures of similar technologies that did not incorporate one or more borohydrides. Moreover, the quantity of the one or more borohydrides required to produce the enhanced effect or synergistic effect is rather minimal.

The inventors have also discovered an unexpected, dramatic enhancing effect between certain components of the mixture of reducing agents, such as the borohydride component, and other additives that can be added with the mixture of reducing agents, such as OBAs and/or chelants. These effects can be seen in the following examples. Thus, each component of the treatment is not simply performing the same function it had been known to perform. The borohydride component of the mixture of reducing agents has an enhancing effect on, for example, the OBAs and/or chelants. Thus, the effect of the present treatment comprising a borohydride in the mixture of reducing agents and any of the additives disclosed herein, such as OBAs, is unexpectedly stronger than previous disclosures of similar technologies that did not incorporate one or more borohydrides. Moreover, the quantity of the borohydride required to produce the enhanced effect or synergistic effect is rather minimal.

The foregoing may be better understood by reference to the following examples, which are presented for purposes of illustration, and are not intended to limit the scope of the disclosure. As can be noted from the examples, the performance is pH-dependent but the brightness improvement is observed over a broad pH range, such as from about 6 to about 11. Therefore, as an advantage, optimal pH based on the other requirements of the sizing solution can be chosen.

EXAMPLES

TABLE 1

Representative Compositions (water not included)

| | Component | % Component |
|---|---|---|
| Composition EW (Part 1) | DTMPA | 3.3 |
| | Sodium polyacrylate | 1.2 |
| | NaOH | To pH 5.5-6.0 |
| | Sodium Metabisulfite | 34.3 |
| Mix 1 (Part 2) | NaBH4 | 12 |
| | NaOH | 39 |

In these examples, sufficient 50% aqueous sodium hydroxide was added to achieve an appropriate pH for the agent or composition being tested. All percentages in these examples are given on a weight percent dry pulp basis. In these examples, the following terms shall have the indicated meaning. Br for ISO brightness R457 (TAPPI 525); Ye for E313 yellowness; WI for E313 Whiteness; TMP for thermomechanical pulp; CTMP for chemi-thermomechanical pulp; RMP for refiner mechanical pulp; OBA for optical brightener; DTPA for $(HO_2CCH_2)_2NCH_2CH_2N(CH_2CO_2H)CH_2CH_2N(CH_2CO_2H)_2$; and Mix 1 is an alkaline solution of sodium borohydride, $NaBH_4$, which contains approximately 39% NaOH and approximately 12% $NaBH_4$.

Treatment:

Commercial bleached kraft paper sheets were used in the experiments, in which the reducing agents were applied via surface sizing followed by drum-drying (temperature during drum drying: 100° C.). The load of the tested agent or composition solution was determined based on the dry weight of the pulp sample. The agent or composition solutions were applied by soaking in a sizing solution. The test sheets were dried using a laboratory drum drier under uniform conditions (one round).

Test Equipment was as follows:

Laboratory drum drier;

"Elrepho 3000," or "Technodyne Color Touch 2 (Model ISO)" or another instrument for brightness measurements;

Micropipette;

Surface size application kit (pad and size 3-application rod);

Constant humidity room (23° C., 50% humidity);

Water bath/thermostat accommodating a floating plastic box with paper samples; and 100-mL application cuvette for the soaking method.

Dry Surface Application Procedure (Surface Sizing, Soaking Method):

1. Condition a paper sheet in a constant humidity room. The target dry weight is 2.5 g.
2. Cut a ⅛$^{th}$ strip of the sheet (0.31 g).
3. In a 50 ml test tube, prepare solutions of pre-cooked starch (if needed) and reducing agent compound solutions based on the pre-determined pickup rate and target dose.
4. Dip the paper strip into the solution for 10 seconds, remove and let it drip for 35 seconds, and then pass it through the press.
5. Drum-dry the test sheet and equilibrate at room temperature.
6. Measure brightness and yellowness.

Pulp Application Procedure:

These experiments were conducted with the goals to (a) clear the mechanism of the synergistic action of the reductive components and (b) explore the possibility of expanding of the finding into the bleaching area. The chemicals were added directly to the pulp via a syringe through septa under nitrogen and mixed with the pulp (5% consistency) in glass flasks. The flasks were kept at 70° C. for 1 h. The slurry was further diluted and hand sheets prepared according to the standard procedure.

TABLE 2

Kraft paper sheet, surface application with starch (surface sizing solution) on both sides OBA = Stilbene Fluorescent Brightener, BH = $NaBH_4$ as Mix 1 (0.21% as product)

| Samples | Brightness | CIE Whiteness | L* | a* | b* |
|---|---|---|---|---|---|
| 0.25% OBA | 101,30 | 123,31 | 96,247 | 1,740 | −7,340 |
| 0.25% OBA pH 9 | 102,50 | 127,17 | 96,210 | 1,970 | −8,230 |

TABLE 2-continued

Kraft paper sheet, surface application with starch (surface sizing solution) on both sides OBA = Stilbene Fluorescent Brightener, BH = $NaBH_4$ as Mix 1 (0.21% as product)

| Samples | Brightness | CIE Whiteness | L* | a* | b* |
|---|---|---|---|---|---|
| 0.25% OBA pH 10 | 102,32 | 126,72 | 96,210 | 1,983 | −8,127 |
| 0.25% OBA pH 11.3 | 102,27 | 126,88 | 96,173 | 2,077 | −8,187 |
| 0.25% OBA + 0.25% EW | 102,52 | 126,65 | 96,330 | 1,903 | −8,053 |
| 0.25% OBA + 0.25% EW pH 10 | 102,02 | 125,48 | 96,280 | 1,917 | −7,813 |
| 0.25% OBA + 0.25% EW pH 11.3 | 102,31 | 126,17 | 96,297 | 1,957 | −7,963 |
| 0.25% OBA + 0.25% EW + 0.025% BH | 103,93 | 127,68 | 96,930 | 1,987 | −8,137 |
| 0.25% OBA + 0.25% EW + 0.025% BH pH 10 | 103,53 | 127,89 | 96,667 | 1,960 | −8,177 |
| 0.25% OBA + 0.25% EW + 0.025% BH pH 7 | 103,33 | 128,33 | 96,460 | 1,953 | −8,373 |
| 0.25% OBA + 0.25% EW + 0.0125% BH | 103,62 | 127,65 | 96,753 | 1,970 | −8,077 |
| 0.25% OBA + 0.25% EW + 0.0125% BH pH 10 | 103,00 | 126,77 | 96,603 | 1,933 | −7,950 |
| 0.25% OBA + 0.25% EW + 0.0125% BH pH 7 | 102,71 | 127,08 | 96,357 | 1,927 | −8,137 |
| 0.25% OBA + 0.25% EW + 0.0125% BH | 103,66 | 127,73 | 96,760 | 1,977 | −8,093 |
| 0.25% OBA + 0.25% EW + 0.0125% BH pH 10 | 102,77 | 127,05 | 96,403 | 1,937 | −8,110 |

TABLE 3

Kraft paper sheet, surface application with starch (surface sizing solution) on both sides OBA = Stilbene Fluorescent Brightener, HS = $Na_2S_2O_4$, BH = $NaBH_4$ as Mix 1 (0.21% as product)

| Samples | Brightness | CIE Whiteness | L* | a* | b* | pH, sizing solution |
|---|---|---|---|---|---|---|
| Starch control | 93.76 | 103.23 | 95.713 | 0.870 | −3.093 | 6.86 |
| 0.25% OBA | 101.14 | 123.21 | 96.203 | 1.747 | −7.337 | 7.10 |
| 0.25% HS | 95.05 | 106.82 | 95.833 | 1.033 | −3.833 | 3.52 |
| 0.25% BH | 94.97 | 103.99 | 96.303 | 0.957 | −2.963 | 11.40 |
| 0.25% EW | 94.58 | 105.42 | 95.803 | 0.960 | −3.537 | 6.45 |
| 0.25% OBA + 0.25% EW | 102.27 | 126.21 | 96.293 | 1.930 | −7.973 | 6.41 |
| 0.25% OBA + 0.25% HS | 102.89 | 127.69 | 96.357 | 1.977 | −8.277 | 3.48 |
| 0.25% OBA + 0.125% HS | 102.21 | 126.00 | 96.300 | 1.893 | −7.920 | 3.37 |
| 0.25% OBA + 0.025% BH | 103.49 | 126.63 | 96.863 | 1.970 | −7.797 | 11.42 |
| 0.25% OBA + 0.25% HS + 0.025% BH | 104.08 | 128.41 | 96.867 | 1.897 | −8.197 | 10.06 |
| 0.25% OBA + 0.125% HS + 0.025% BH | 104.16 | 128.30 | 96.943 | 1.977 | −8.137 | 11.20 |
| 0.25% OBA + 0.125% HS + 0.0125% BH | 103.09 | 127.02 | 96.607 | 1.897 | −8.003 | 9.55 |
| 0.25% OBA + 0.25% EW + 0.025% BH | 104.42 | 128.89 | 96.943 | 2.000 | −8.267 | 11.20 |
| 0.25% OBA + 0.25% HS + 0.025% BH | 104.25 | 128.61 | 96.920 | 1.897 | −8.217 | 10.09 |
| 0.25% OBA + 0.125% HS + 0.0125% BH | 103.15 | 127.16 | 96.613 | 1.900 | −8.033 | 9.15 |

TABLE 4

TMP, bleaching conditions (70 C., 1 h, 5% consistency, under nitrogen)

| Samples | Brightness |
|---|---|
| 1% Na2S2O4 | 60.70 |
| 2% EW | 55.99 |
| 0.21% Mix 1* | 54.93 |
| 2% EW + 0.21% Mix 1* | 59.30 |
| 1% EW + 0.21% Mix 1* | 57.90 |

*0.025% NaBH4

TABLE 5

TMP, bleaching conditions (70 C., 1 h, 5% consistency, under nitrogen)

| Samples | Brightness |
|---|---|
| 1% Na2S2O4 | 58.22 |
| 2% EW | 51.07 |
| 0.21% Mix 1* | 49.27 |
| 2% EW + 0.21% Mix 1* | 55.23 |
| 1% EW + 0.21% Mix 1* | 54.11 |

*0.025% NaBH4

The effect can readily be seen in Table 3 of the present application. Here, for example, the inventors have achieved a significant brightness improvement with 0.25% and 0.125% sodium hydrosulfide (HS) when a borohydride is included in the mixture, and the effect is stronger than from the borohydride and HS separately. This means that with a small quantity of a borohydride, one can significantly reduce the required quantity of the main product, which can be a composition containing a sulfur-based reductive chemical, such as sodium bisulfite, as a main component. The borohydride enhancement can also readily be seen in Tables 4 and 5. Mix 1 by itself brings the brightness down but enhances the effect of composition "EW," which is described in Table 1, when applied in a small quantity together with EW.

All of the compositions and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated. In addition, unless expressly stated to the contrary, use of the term "a" is intended to include "at least one" or "one or more."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the invention encompasses any and all possible combinations of some or all of the various embodiments described herein. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

What is claimed is:

1. A method for preparing a bleached pulp material having enhanced brightness and enhanced resistance to thermal yellowing comprising:

i) providing bleached kraft pulp material; and ii) contacting the bleached kraft pulp material with a solution, the solution having a pH of about 10 to about 11 and comprising about 0.25% of a stilbene fluorescent optical brightening agent and about 0.025% of a mixture, the mixture comprising about 12% sodium borohydride and about 39% sodium hydroxide, wherein the solution is added to the bleached pulp in a manner selected from the group consisting of (a) in the press section; (b) in the drying section; (c) on the calender using a wafer box; (d) on paper in an off-machine coater or size press; (e) in the curl control unit; and (f) any combination thereof, wherein the stilbene fluorescent optical brightening agent is selected from the group consisting of: disulfonated stilbenes, disulfonated stilbene derivatives, tetrasulfonated stilbenes, tetrasulfonated stilbene derivatives, hexasulfonated stilbenes, and hexasulfonated stilbene derivatives.

2. The method of claim 1, wherein the solution is mixed with a surface sizing solution and applied to the bleached kraft pulp material in a size press.

3. The method of claim 1, wherein the stilbene fluorescent optical brightening agent is selected from the group consisting of: tetrasulfonated stilbenes and hexasulfonated stilbenes.

4. The method of claim 1, further comprising contacting the bleached pulp material with a chelant.

5. The method of claim 4, wherein the chelant is selected from the group consisting of diethylene-triamine-pentamethylene phosphonic acid (DTMPA) and salts thereof, salts of diethylene-triamine-pentamethylene phosphonic acid (DTMPA), diethylenetriaminepentaacetic acid (DTPA), salts of diethylenetriaminepentaacetic acid (DTPA), ethylenediaminetetraacetic acid (EDTA), salts of ethylenediaminetetraacetic acid (EDTA), and any combination thereof.

6. The method of claim 1, wherein the solution further comprises sodium bisulfate.

7. The method of claim 1, further comprising contacting the bleached pulp material with one or more polycarboxylates.

8. The method of claim 7, wherein the one or more polycarboxylates comprises partially neutralized polyacrylic acid.

9. A method for preparing a bleached pulp material having enhanced brightness and enhanced resistance to thermal yellowing, the method consisting of:

contacting a kraft paper sheet with a solution, the solution consisting of a pH of about 10 to about 11, 0.25% of a stilbene fluorescent optical brightening agent, and 0.025% of a mixture, the mixture consisting of water, 12% sodium borohydride, and 39% sodium hydroxide, wherein the stilbene fluorescent optical brightening agent is selected from the group consisting of: disulfonated stilbenes, disulfonated stilbene derivatives, tetrasulfonated stilbenes, tetrasulfonated stilbene derivatives, hexasulfonated stilbenes, and hexasulfonated stilbene derivatives.

* * * * *